US011132941B2

(12) United States Patent
Xi et al.

(10) Patent No.: US 11,132,941 B2
(45) Date of Patent: Sep. 28, 2021

(54) DISPLAY PANEL AND PIXEL CIRCUIT THEREOF

(71) Applicant: Au Optronics Corporation, Hsinchu (TW)

(72) Inventors: Peng-Bo Xi, Hsinchu (TW); Chen-Chi Lin, Hsinchu (TW); Yan-Ru Chen, Hsinchu (TW); Cheng-Nan Yeh, Hsinchu (TW); Sheng-Yu Hsu, Hsinchu (TW); Chia-Che Hung, Hsinchu (TW); En-Chih Liu, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 17/016,388

(22) Filed: Sep. 10, 2020

(65) Prior Publication Data

US 2021/0193026 A1 Jun. 24, 2021

(30) Foreign Application Priority Data

Dec. 24, 2019 (TW) ..... 108147304
Jun. 19, 2020 (TW) ..... 109120751

(51) Int. Cl.
*G09G 3/32* (2016.01)

(52) U.S. Cl.
CPC ..... *G09G 3/32* (2013.01); *G09G 2310/0275* (2013.01); *G09G 2310/08* (2013.01)

(58) Field of Classification Search
CPC ..... G09G 3/32; G09G 2310/0275; G09G 2310/08
See application file for complete search history.

(56) References Cited

U.S. PATENT DOCUMENTS

| | | | | |
|---|---|---|---|---|
| 9,842,542 | B2 | 12/2017 | Duan et al. | |
| 2016/0307510 | A1 | 10/2016 | Duan et al. | |
| 2018/0293929 | A1 | 10/2018 | Shigeta et al. | |
| 2019/0347980 | A1* | 11/2019 | Kuo | G09G 3/32 |
| 2019/0347981 | A1* | 11/2019 | Horowitz | G09G 3/02 |
| 2019/0371232 | A1* | 12/2019 | Kim | G09G 3/32 |
| 2021/0065616 | A1* | 3/2021 | Kim | G09G 3/3233 |

FOREIGN PATENT DOCUMENTS

CN 104464644 3/2015

* cited by examiner

*Primary Examiner* — Andrew Sasinowski
(74) *Attorney, Agent, or Firm* — JCIPRNET

(57) ABSTRACT

A display panel and a pixel circuit of the display panel are provided. The pixel circuit includes a driving transistor and a light-emitting time length modulator. The driving transistor has a control terminal receiving a pulse width control signal and an amplitude control signal, and the driving transistor generates a driving signal. In a first time period, the light-emitting time length modulator modulates a time length of a plurality of second time periods for providing the driving signal to a light-emitting device according to a light-emitting time control signal.

22 Claims, 15 Drawing Sheets

DISPLAY PANEL AND PIXEL CIRCUIT THEREOF

CROSS-REFERENCE TO RELATED APPLICATION

This application claims the priority benefits of Taiwan patent application serial no. 108147304, filed on Dec. 24, 2019, and Taiwan patent application serial no. 109120751, filed on Jun. 19, 2020. The entirety of each of the above-mentioned patent applications is hereby incorporated by reference and made a part of this specification.

BACKGROUND

Technical Field

The disclosure relates to a display panel and a pixel circuit.

Description of Related Art

With the evolution of electronic technology, it has become an important trend to equip electronic apparatuses with high-quality display devices, and a successfully miniaturized active light-emitting diode (LED) has become a mainstream design for a flat panel display (FPD).

In the conventional technical field, brightness control of the LED may be based on pulse width modulation (PWM) and amplitude modulation. Based on work efficiency requirements of the LED, given that the LED has a high external quantum efficiency (EQE), the LED is required to operate with a sufficient amount of driving current. As a result, the high EQE of the LED cannot be effectively maintained by amplitude modulation. Besides, the PWM mechanism also faces design difficulties in response to requirements for high resolution. In addition, on the premise of maintaining the high EQE, the total amount of current flowing through the display panel may be excessive, which leads to the unlikelihood of implementation.

SUMMARY

The disclosure provides various pixel circuits and a display panel composed of the pixel circuits, which may improve a light-emitting efficiency of an LED.

An embodiment of the disclosure provides a pixel circuit that includes a driving transistor and a light-emitting time length modulator. The driving transistor has a control terminal receiving a pulse width control signal and an amplitude control signal, and the driving transistor generates a driving signal. The light-emitting time length modulator is coupled to the driving transistor, a control switch, and the light-emitting device in series. In a first time period, the light-emitting time length modulator modulates a time length of a plurality of second time periods during which the driving signal is provided to the light-emitting device according to a light-emitting time control signal.

An embodiment of the disclosure provides another pixel circuit that includes a first control switch, a driving transistor, a second control switch, a first capacitor, and a first transistor to a fifth transistor. The first control switch has a first terminal that receives a power voltage and is controlled by a light-emitting signal. The driving transistor has a first terminal coupled to a second terminal of the first control switch. The second control switch is coupled between a second terminal of the driving transistor and the light-emitting device and controlled by the light-emitting signal. The first capacitor has one terminal receiving the power voltage and the other terminal coupled to a control terminal of the driving transistor. The first transistor has a first terminal receiving display data, a second terminal coupled to the control terminal of the driving transistor, and a control terminal receiving a first reset signal. The second transistor has a first terminal coupled to the second terminal of the first transistor, a second terminal coupled to the second terminal of the driving transistor, and a control terminal receiving a first gate driving signal. The third transistor has a first terminal receiving the display data and a second terminal coupled to the control terminal of the driving transistor. The second capacitor has one terminal receiving a timing control signal and the other terminal coupled to a control terminal of the third transistor. The fourth transistor has a first terminal coupled to the control terminal of the third transistor, a second terminal coupled to the control terminal of the driving transistor, and a control terminal receiving a second reset signal or a second gate driving signal. The fifth transistor has a first terminal receiving the display data, a second terminal coupled to the first terminal of the driving transistor, and a control terminal receiving the first gate driving signal.

An embodiment of the disclosure provides a display panel that includes a plurality of first pixel arrays and a plurality of second pixel arrays. Each of the first pixel array has a plurality of first pixel circuits. The second pixel arrays are staggered with the first pixel arrays, and each of the second pixel arrays has a plurality of second pixel circuits. Here, each of the first pixel circuits and the second pixel circuits includes a driving transistor, a control switch, and a light-emitting time length modulator. The driving transistor has a control terminal receiving a pulse width control signal and an amplitude control signal, and the driving transistor generates a driving signal. The control switch is coupled to the driving transistor and the light-emitting device in series to control a first time period during which the driving transistor generates the driving signal according to a light-emitting signal. The light-emitting time length modulator is coupled to the driving transistor, the control switch, and the light-emitting device in series. In the first time period, the light-emitting time length modulator modulates a time length of a plurality of second time periods during which the driving signal is provided to the light-emitting device according to a first light-emitting time control signal or a second light-emitting time control signal.

In view of the above, in the display panel and one pixel circuit provided in one or more embodiments of the disclosure, the light-emitting time length modulator is applied to divide the first time period (the light-emitting time period) into a plurality of second time periods, whereby the brightness is modulated. As such, the light-emitting device provided herein may stay working at the high EQE, and a uniform high brightness modulation may be performed. The other pixel circuit provided in one or more embodiments of the disclosure may have the reduced number of required devices through circuit integration, and the output quality of the driving signal may be stabilized.

Several exemplary embodiments accompanied with figures are described in detail below to further describe the disclosure in details.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1A:
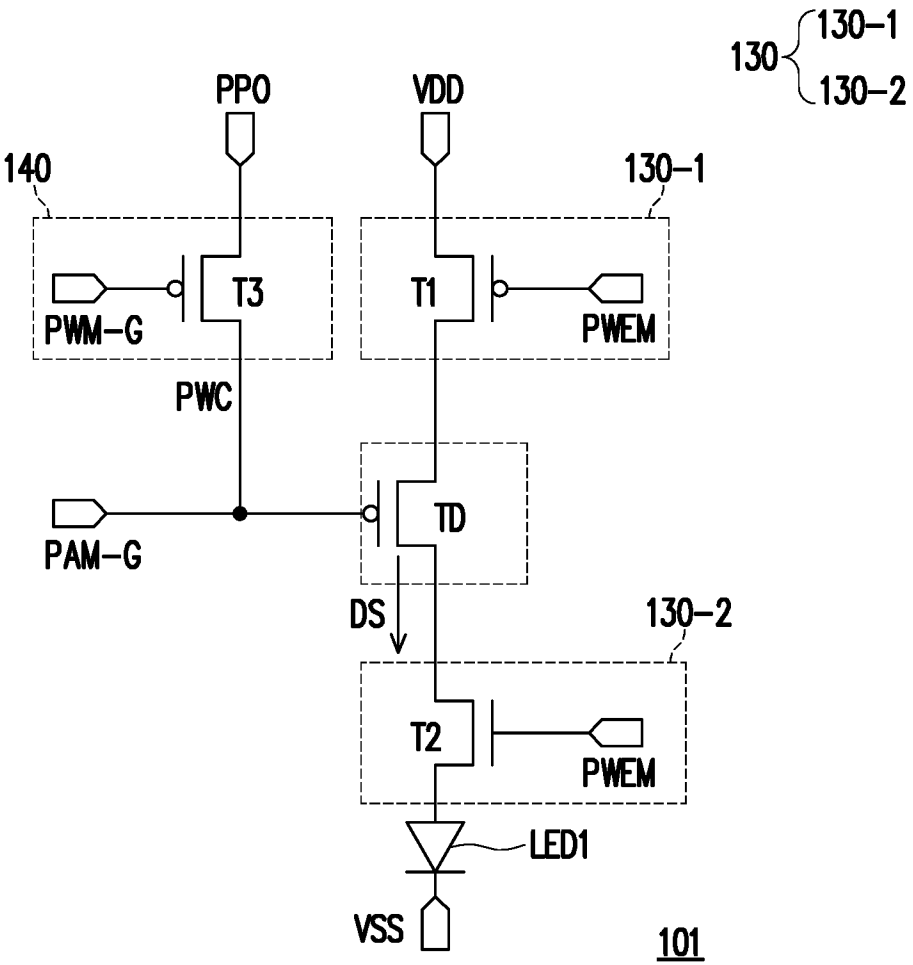
FIG. 1A is a schematic diagram of a pixel circuit according to an embodiment of the disclosure.

FIG. 1A is a schematic diagram of a pixel circuit according to an embodiment of the disclosure. As shown in FIG. 1A, a pixel circuit 100 includes a driving transistor TD and a light-emitting time length modulator 130 composed of circuits 130-1 and 130-2. The driving transistor TD has a control terminal receiving a pulse width control signal PWC and an amplitude control signal PAM-G. The pulse width control signal PWC is generated according to a PWM signal PWM-G. The driving transistor TD generates a driving signal DS. In the embodiment, a light-emitting device LED1 may be a light-emitting diode (LED) of any form.

On the other hand, the circuits 130-1 and 130-2 in the light-emitting time length modulator 130 are coupled to the driving transistor TD and the light-emitting device LED1 in series. The driving transistor TD is coupled between the circuits 130-1 and 130-2. In the embodiment, the circuits 130-1 and 130-2 are composed of transistors T1 and T2, respectively, and are coupled among the driving transistor TD, a power voltage VDD, and the light-emitting device LED1. Control terminals of the transistors T1 and T2 receive a light-emitting time control signal PWEM and are switched on or off according to the light-emitting time control signal PWEM. Here, according to light-emitting time control signal PWEM, the transistors T1 and T2 are switched on in a plurality of second time periods in a first time period (a light-emitting time period). Time lengths of the second time periods may be adjusted according to the light-emitting time control signal PWEM, whereby the brightness of the light emitted by the light-emitting device LED1 may be adjusted.

In some embodiments of the disclosure, one of the circuits 130-1 and 130-2 in the light-emitting time length modulator 130 may be selected to be implemented. It is unnecessary to form the circuits 130-1 and 130-2 at the same time to form the light-emitting time length modulator 130.

Figure 1B:
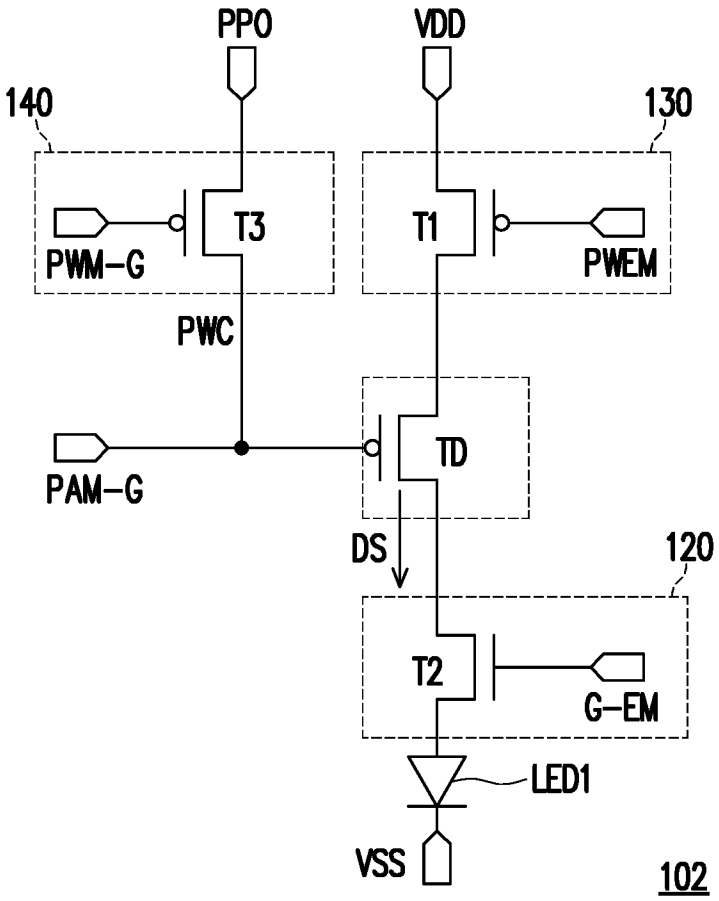
FIG. 1B is a schematic diagram of a pixel circuit according to another embodiment of the disclosure.

FIG. 1B is a schematic diagram of a pixel circuit according to another embodiment of the disclosure. As shown in FIG. 1B, a pixel circuit 102 includes the driving transistor TD, a control switch 120, and a light-emitting time length modulator 130. The driving transistor TD has a control terminal receiving a pulse width control signal PWC and an amplitude control signal PAM-G. The driving transistor TD generates a driving signal DS. The control switch 120 is coupled to the driving transistor TD and the light-emitting device LED1 in series. The control switch 120 controls a first time period during which the driving transistor TD generates the driving signal DS according to a light-emitting signal G-EM. In the embodiment, the control switch 120 is composed of a transistor T2. The transistor T2 is coupled between a first terminal of the driving transistor TD and the light-emitting device LED1. A control terminal of the transistor T2 receives the light-emitting signal G-EM, and in the first time period during which the transistor T2 is switched on according to the light-emitting signal G-EM, the driving signal DS is provided to the light-emitting device LED1 to drive the light-emitting device LED1 to emit light.

In the embodiment of the disclosure, note that a frequency of a light-emitting time control signal PWEM is higher than a frequency of the light-emitting signal G-EM.

Figure 2:
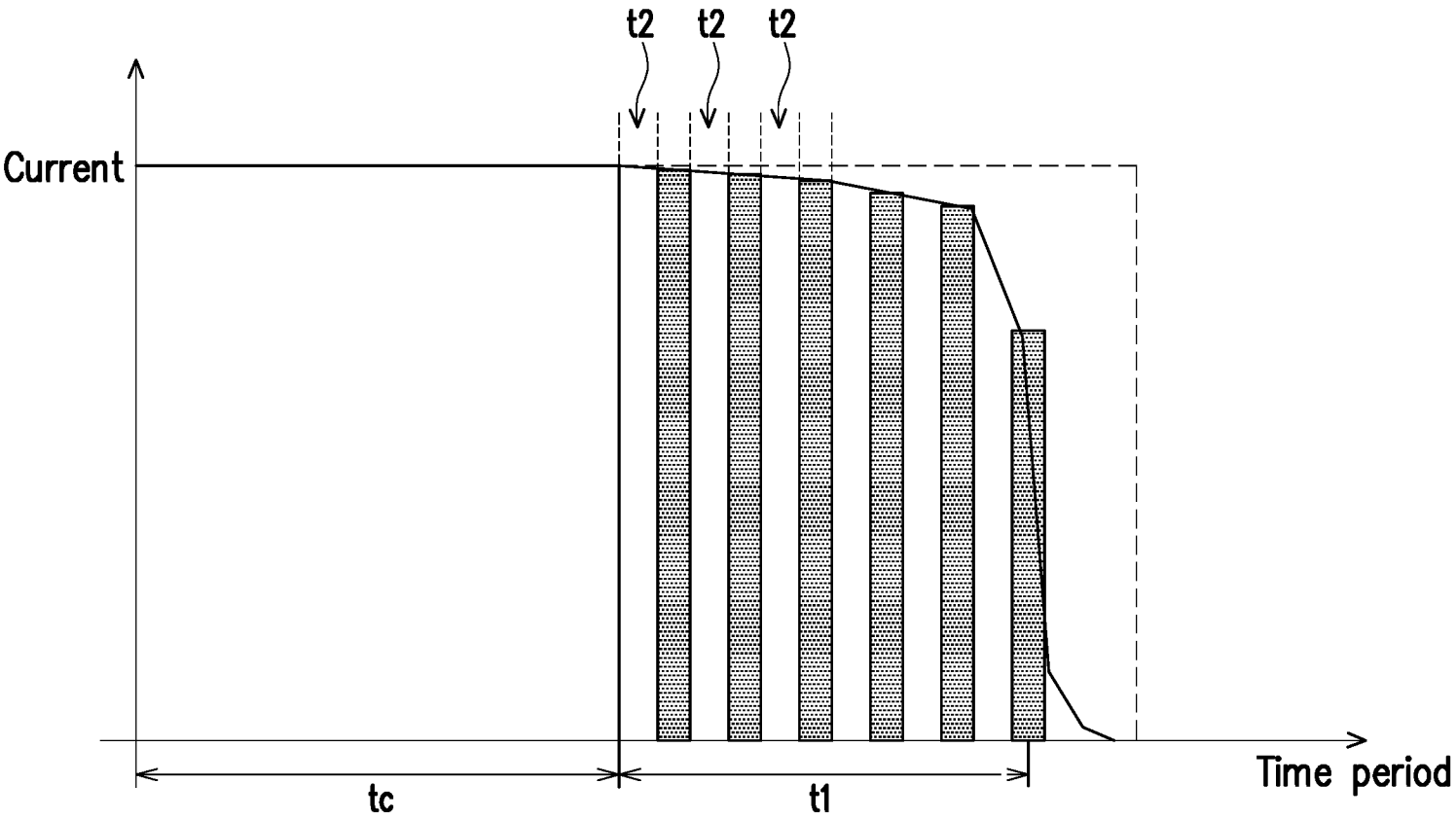
FIG. 2 schematically illustrates an operation of a pixel circuit according to an embodiment of the disclosure.

Please refer to FIG. 1B and FIG. 2 synchronously. FIG. 2 schematically illustrates an operation of a pixel circuit according to an embodiment of the disclosure. The horizontal axis in FIG. 2 represents time, and a vertical axis in FIG. 2 represents a current of the driving signal DS. In FIG. 2, in a compensation time period tc, the pixel circuit 100 may perform a circuit compensation operation, and in a first time period t1, the control switch 120 is switched on. In addition, in a plurality of second time periods t2 in the first time period t1, the transistor T1 in the pixel circuit 100 is switched on according to the light-emitting time control signal PWEM, and brightness of the light emitted by the light-emitting device LED1 is adjusted according to the time lengths of the second time periods.

As shown in FIG. 2, when the brightness generated by the light-emitting device LED1 is to be adjusted to a low display brightness, in addition to reducing the time length of the first time period t1, the time lengths of the second time periods t2 may also be reduced. In the embodiment of the disclosure, note that it is not necessary to reduce the brightness of the light emitted by the light-emitting device LED1 by reducing the current value of the driving signal DS, and the light-emitting device (the LED) LED1 may continue to operate on the high EQE working conditions.

In addition, in the embodiment, the pixel circuit 100 further includes a pulse width control signal generator 140. The pulse width control signal generator 140 is coupled to the control terminal of the driving transistor TD and generates a pulse width control signal PWC according to a PWM signal PWM-G. In the embodiment, the pulse width control signal generator 140 is composed of a transistor T3. A terminal of the transistor T3 receives a reference voltage PPO, and another terminal is coupled to the control terminal of the driving transistor TD and provides the pulse width control signal PWC. A control terminal of the transistor T3 receives the PWM signal PWM-G, and the transistor T3 is switched on or off according to the PWM signal PWM-G. The reference voltage PPO may be a PWM pinch off voltage.

Incidentally, the position of the light-emitting time length modulator 130 and the position of the control switch 120 in FIG. 1B may be exchanged and should not be construed as limitations in the disclosure. In the embodiment, the control switch 120 is disposed relatively adjacent to the light-emitting device LED1, and the light-emitting time length modulator 130 is disposed relatively far from the light-emitting device LED1, which may lessen the impact on the light-emitting effects of the light-emitting device LED1 by the light-emitting time control signal PWEM with a relatively high frequency.

In the embodiment, the transistors T1-T3 and the driving transistor TD may be p-type transistors. An anode of the light-emitting device LED1 is coupled to the transistor T2, and a cathode of the light-emitting device LED1 is coupled to a reference power VSS.

Figure 3:
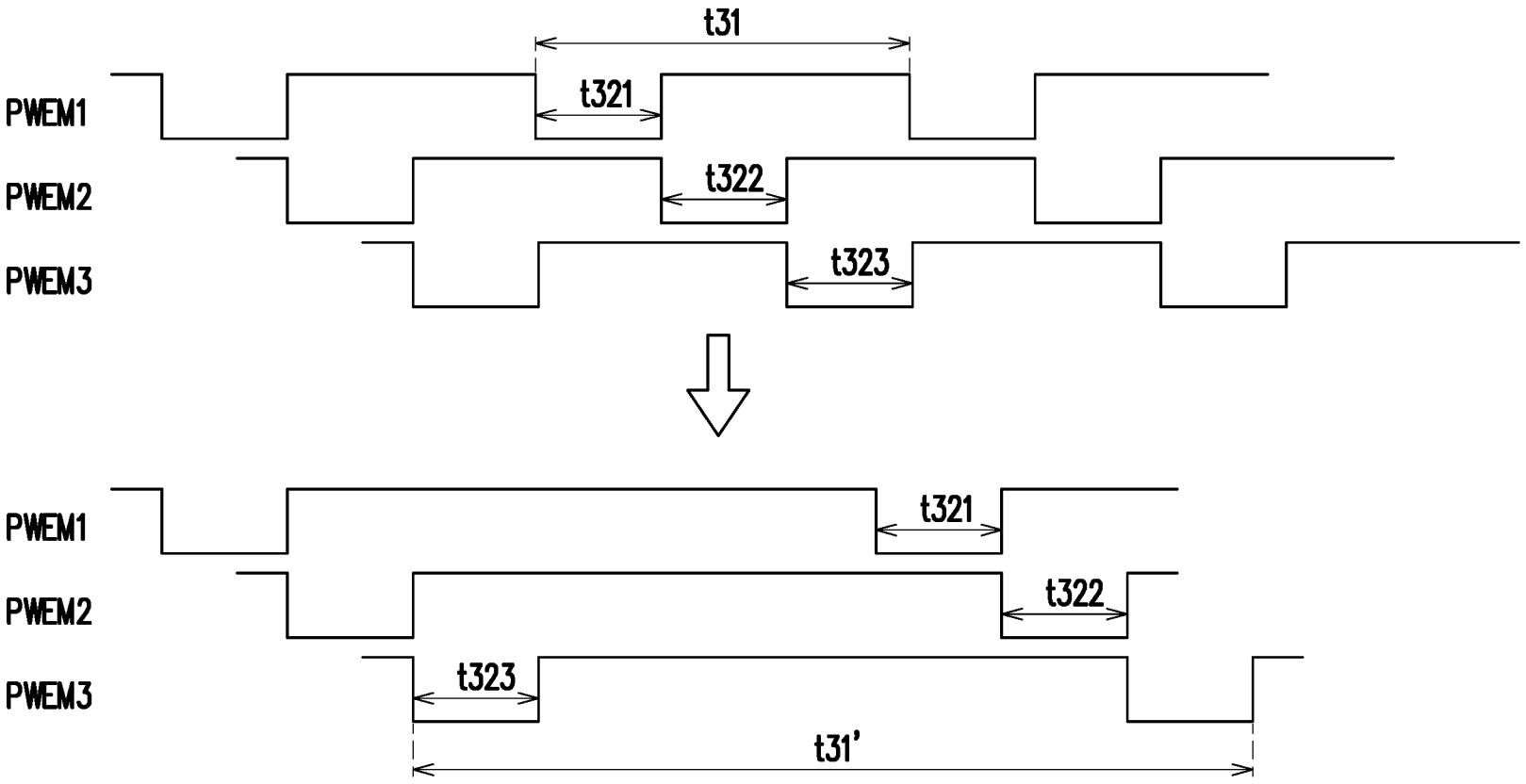
FIG. 3 is an operational waveform of a pixel circuit according to an embodiment of the disclosure.

Please refer to FIG. 3, which is an operational waveform of a pixel circuit according to an embodiment of the disclosure. In a structure of a plurality of pixel circuits, the pixel circuits respectively receive light-emitting time control signals PWEM1-PWEM3. As shown by the waveforms in the upper-half of FIG. 3, in a first time period t31, the light-emitting time control signals PWEM1-PWEM3 may be respectively enabled in a plurality of second time periods t321-t323, whereby the brightness of corresponding light-emitting devices may be adjusted. In addition, as shown by the waveforms in the lower-half of FIG. 3, by adjusting the time length of the first time period t31 to the time length of the first time period t31', the brightness of the light emitted by the light-emitting device may be reduced while the EQE of the light-emitting device stays unchanged.

Figure 4B:
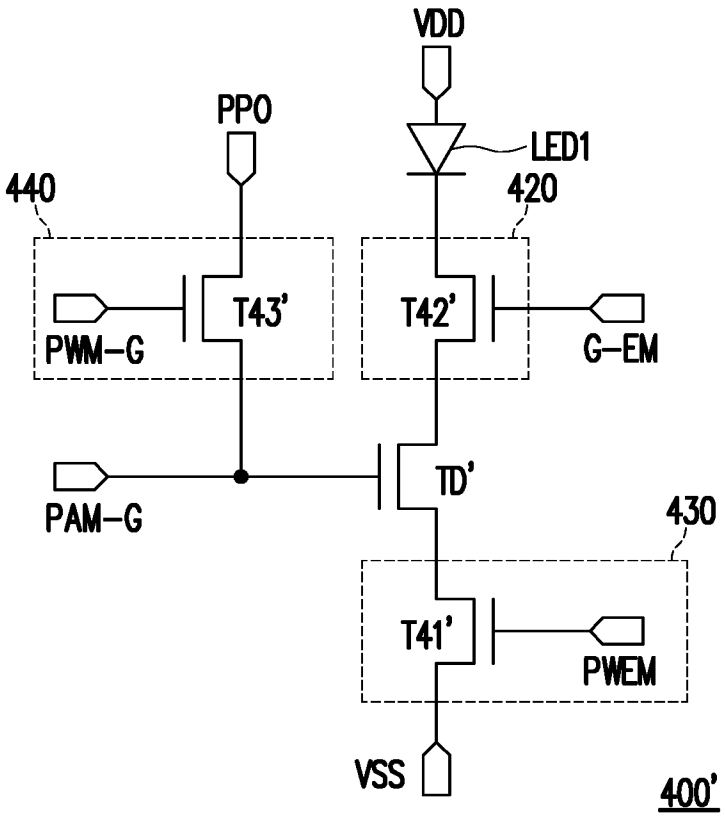
FIG. 4A and FIG. 4B schematically illustrate different implementation manner of a pixel circuit according to an embodiment of the disclosure, respectively.
Figure 4A:
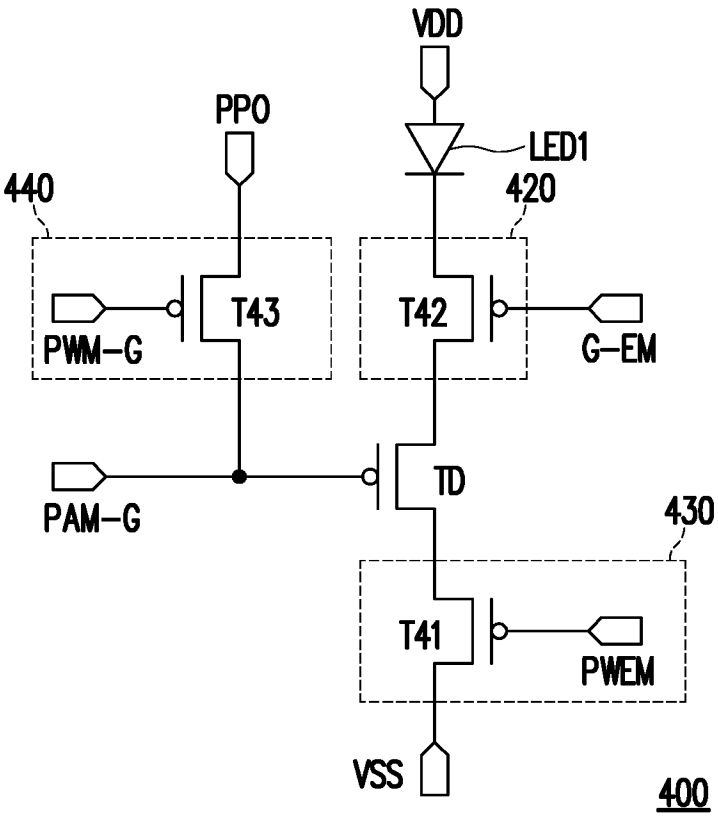

Next, please refer to FIG. 4A and FIG. 4B, which schematically illustrate different implementation manner of a pixel circuit according to an embodiment of the disclosure, respectively. In FIG. 4A, a pixel circuit 400 includes the driving transistor TD, a control switch 420, a light-emitting time length modulator 430, and a pulse width control signal generator 440. Unlike the embodiments depicted in FIG. 1A and FIG. 1B, the light-emitting device LED1 is coupled between the power voltage VDD and the control switch 420. In addition, in the pixel circuit 400, the control switch 420 is composed of a transistor T42, the light-emitting time length modulator 430 is composed of a transistor T41, and the pulse width control signal generator 440 is composed of a transistor T43. Here, the driving transistor TD and the transistors T41-T43 are p-type transistors.

In FIG. 4B, the control switch 420, the light-emitting time length modulator 430, and the pulse width control signal generator 440 in a pixel circuit 400' are composed of transistors T41', T42', and T43', respectively; moreover, a driving transistor TD' and the transistors T41'-T43' in the pixel circuit 400' may all be n-type transistors.

Figure 5:
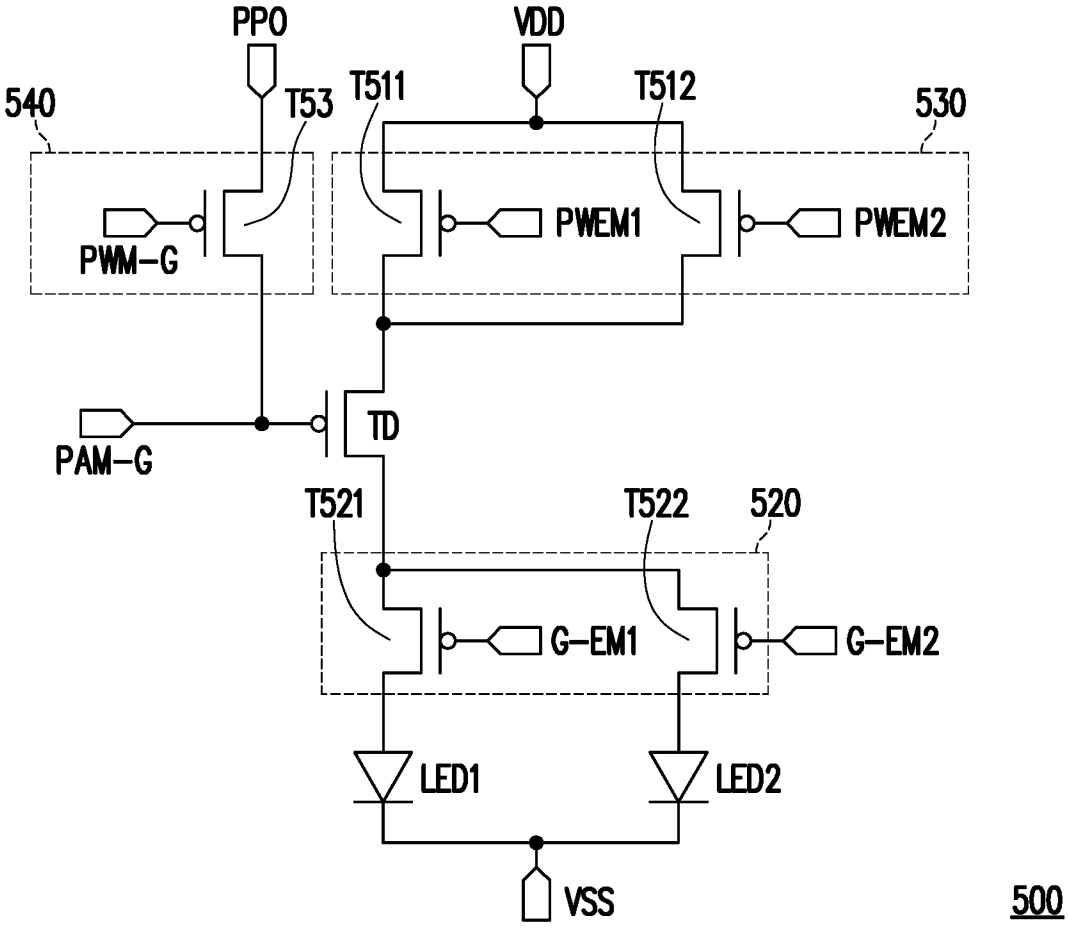
FIG. 5 is a schematic diagram of a pixel circuit according to another embodiment of the disclosure.

FIG. 5 is a schematic diagram of a pixel circuit according to another embodiment of the disclosure. As shown in FIG. 5, a pixel circuit 500 includes the driving transistor TD, a control switch 520, a light-emitting time length modulator 530, and a pulse width control signal generator 540. In the embodiment, the control switch 520 includes transistors T521 and T522. First terminals of the transistors T521 and T522 are commonly coupled to the driving transistor TD, and second terminals of the transistors T521 and T522 are respectively coupled to light-emitting devices LED1 and LED2, respectively. The transistors T521 and T522 are controlled by light-emitting signals G-EM1 and G-EM2, respectively.

In response to the control switch 520, the light-emitting time length modulator 530 has transistors T511 and T512. First terminals of the transistors T511 and T512 commonly receive the power voltage VDD, and second terminals of the transistors T511 and T512 are commonly coupled to the driving transistor TD. The transistors T511 and T512 are respectively controlled by the light-emitting time control signal PWEM1 and the light-emitting time control signal PWEM2.

In the first time period during which the transistor T521 is switched on, the transistor T511 may be switched on and off in an alternate manner according to the light-emitting time control signal PWEM1, so as to adjust the brightness of the light emitted by the light-emitting device LED1. On the other hand, in another first time period during which the transistor T522 is switched on, the transistor T512 may be switched on and off in an alternate manner according to the light-emitting time control signal PWEM2, so as to adjust the brightness of the light emitted by the light-emitting device LED 2.

In the embodiment, the light-emitting devices LED1 and LED2 are LEDs that may transmit light beams of different wavelengths, respectively.

Incidentally, the pulse width control signal generator 540 may be composed of the transistor T53.

Figure 6:
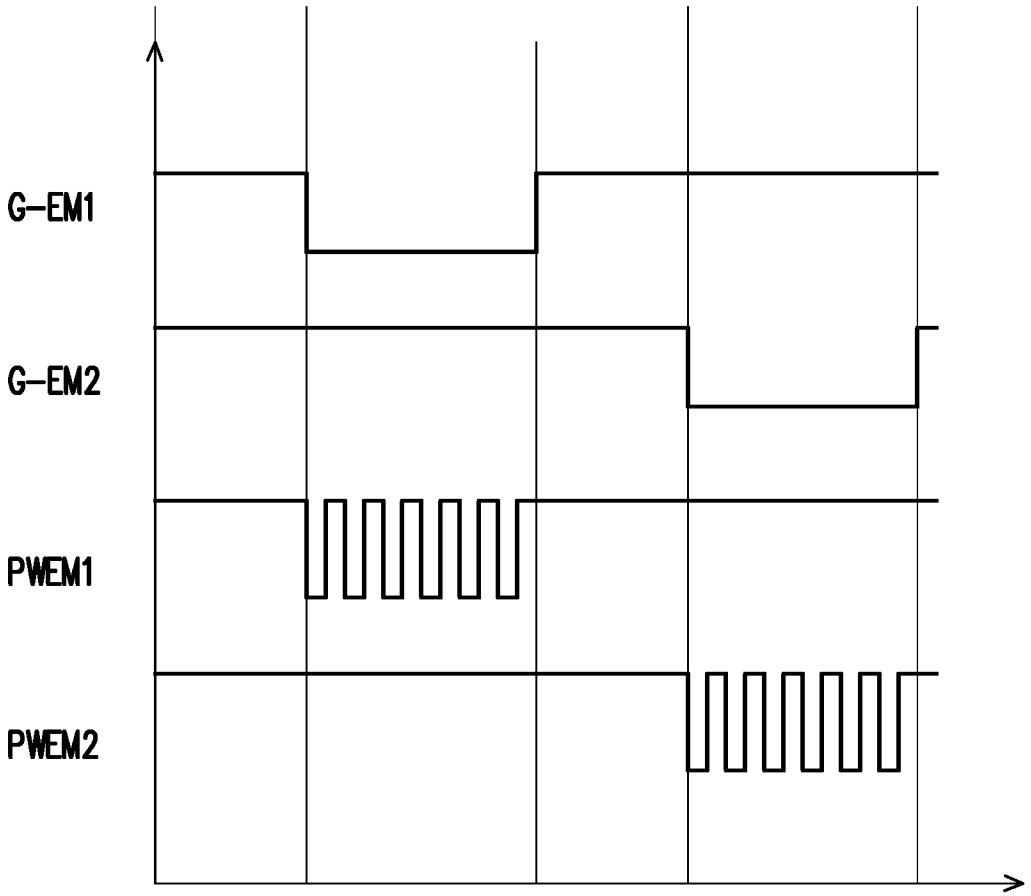
FIG. 6 is an operational waveform of the pixel circuit according to the embodiment depicted in FIG. 5.

FIG. 6 is an operational waveform of the pixel circuit according to the embodiment depicted in FIG. 5. When the light-emitting signal G-EM1 is in an enabled state (pulled down to a relatively low voltage level), the light-emitting time control signal PWEM1 may be alternately disabled (raised to a relatively high voltage level) and enabled (pulled down to a relatively low voltage level), so as to adjust the brightness of the light emitted by the light-emitting device LED1. On the other hand, when the light-emitting signal G-EM2 is in an enabled state (pulled down to a relatively low voltage level), the light-emitting time control signal PWEM2 may be alternately disabled (pulled up to a relatively high voltage level) and enabled (pulled down to a relatively low voltage level), so as to adjust the brightness of the light emitted by the light-emitting device LED2.

Figure 7:
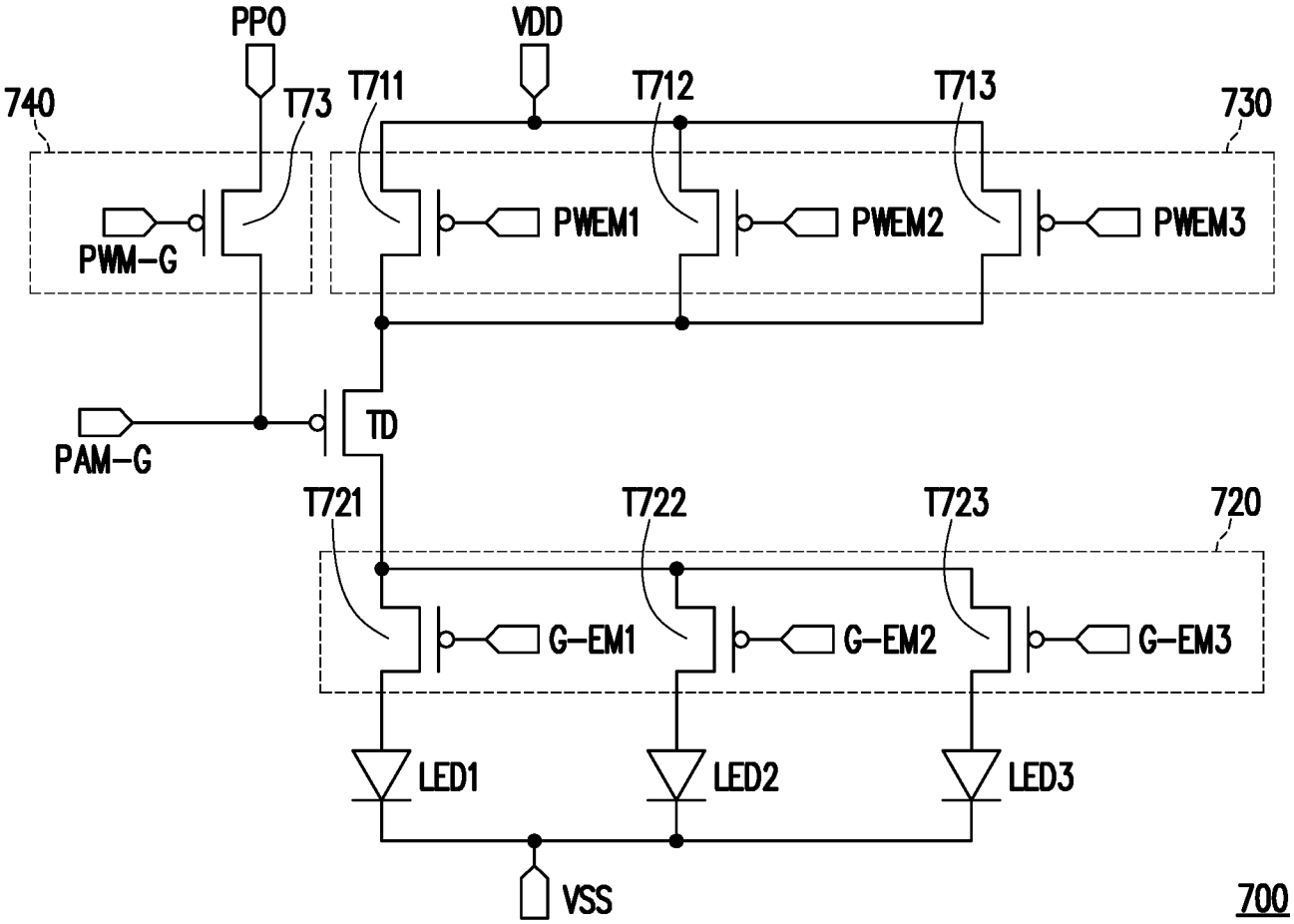
FIG. 7 is a schematic diagram of a pixel circuit according to another embodiment of the disclosure.

FIG. 7 is a schematic diagram of a pixel circuit according to another embodiment of the disclosure. As shown in FIG. 7, a pixel circuit 700 includes the driving transistor TD, a control switch 720, a light-emitting time length modulator 730, and a pulse width control signal generator 740. The difference between the pixel circuit 700 and the pixel circuit 500 provided in the previous embodiment lies in that the control switch 720 includes three transistors T721-T723 respectively coupled to three light-emitting devices LED1-LED3. The light-emitting time length modulator 730 includes transistors T711-T713 corresponding to the transistors T721-T723, respectively.

An operation manner of the pixel circuit 700 in this embodiment is similar to that of the pixel circuit 500 and thus will not be further described hereinafter. The light-emitting devices LED1-LED3 may emit light beams of different wavelengths.

Incidentally, the pulse width control signal generator 740 may be composed of the transistor T73.

Figure 8:
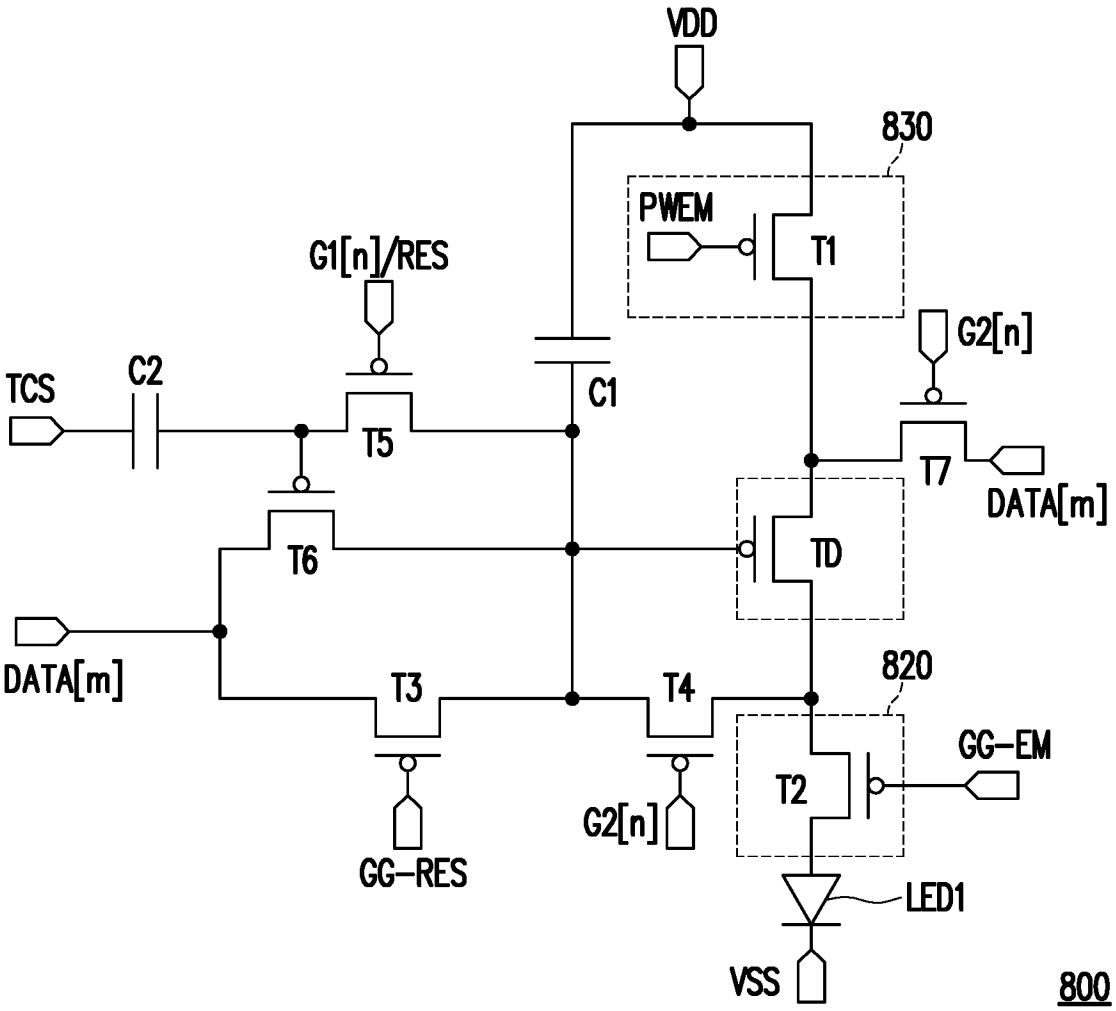
FIG. 8 schematically illustrates an implementation manner of a pixel circuit according to an embodiment of the disclosure.

FIG. 8 schematically illustrates an implementation manner of a pixel circuit according to an embodiment of the disclosure. As shown in FIG. 8, a pixel circuit 800 includes the driving transistor TD, a control switch 820, a light-emitting time length modulator 830, transistors T3-T7, and capacitors C1-C2, and the transistors T3-T7 and the capacitors C1-C2 constitute peripheral circuits. In the embodiment, the driving transistor TD, the control switch 820, and the light-emitting time length modulator 830 are serially connected between the power voltage VDD and the light-emitting device LED1, and the light-emitting device LED1 is coupled to the reference power VSS. In addition, a first terminal of the transistor T3 receives display data DATA[m] and is controlled by a reset signal GG-RES. A first terminal of the transistor T4 is coupled to a second terminal of the transistor T3, a second terminal of transistor T4 is coupled to the first terminal of the driving transistor TD (the coupling end point to the control switch 820), and the transistor T4 is controlled by a gate driving signal G2[n]. The capacitor C1 is coupled between the power voltage VDD and the control terminal of the driving transistor TD. The capacitor C2 has a first terminal receiving a timing control signal TCS, and a second terminal coupled to the transistors T6 and T5. A first terminal of the transistor T5 is coupled to the second terminal of the capacitor C2, and a control terminal of the transistor T5 receives a gate driving signal G1 [n] or the reset signal RES. A second terminal of the transistor T5 is coupled to the control terminal of the driving transistor TD. The transistor T6 has a first terminal receiving the display data DATA[m], a second terminal coupled to the control terminal of the driving transistor TD, and a control terminal coupled to the second terminal of the capacitor C2. The transistor T7 has a first terminal receiving the display data DATA[m], a second terminal coupled to the second terminal of the driving transistor TD, and a control terminal receiving the gate driving signal G2[n].

In the embodiment, the control switch 820 and the light-emitting time length modulator 830 are respectively composed of the transistors T2 and T1 and together form an 8T2C circuit architecture. The pixel circuit 800 may be disposed in a display panel having a pixel circuit array and may drive the light-emitting device LED1 in a preset time sequence according to the gate driving signals G1[n] and G2[n] and the timing control signal TCS.

Figure 9:
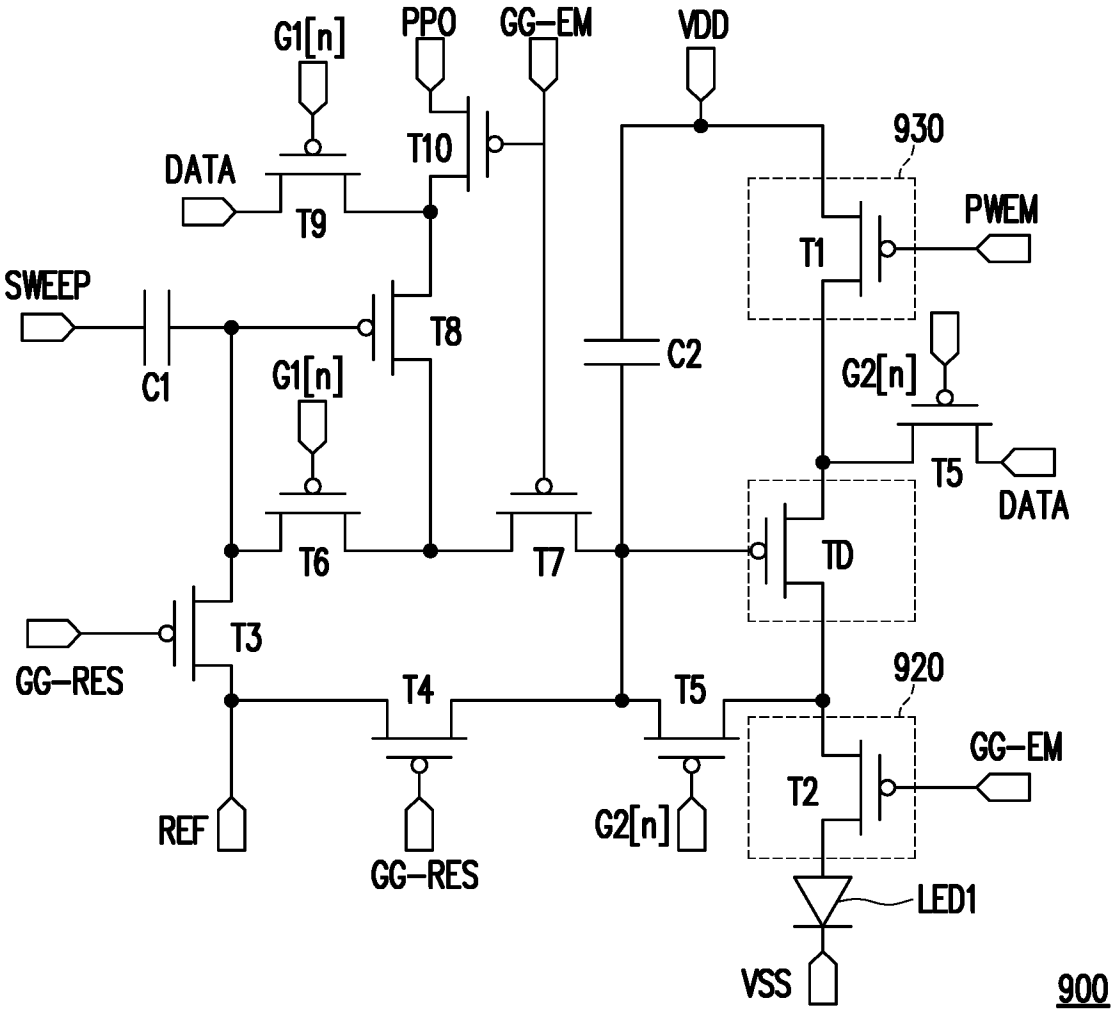
FIG. 9 schematically illustrates another implementation manner of a pixel circuit according to an embodiment of the disclosure.

FIG. 9 schematically illustrates another implementation manner of a pixel circuit according to an embodiment of the disclosure. As shown in FIG. 9, a pixel circuit 900 includes the driving transistor TD, a control switch 920, a light-emitting time length modulator 930, transistors T3-T10, and the capacitors C1-C2, and the transistors T3-T10 and the capacitors C1-C2 constitute peripheral circuits. The capacitor C1 has a first terminal receiving a scan signal TCS. The transistor T3 has a first terminal coupled to a second terminal of the capacitor C1, a second terminal of the transistor T3 receives the reference signal REF, and the transistor T3 is controlled by the reset signal GG-RES. The transistor T4 has a first terminal receiving the reference signal REF, a control terminal receiving the reset signal GG-RES, and a second terminal coupled to the control terminal of the driving transistor TD. The transistor T5 has a first terminal coupled to the control terminal of the driving transistor TD, a second terminal coupled to the first terminal of the driving transistor TD, and a control terminal receiving the gate driving signal G2[n]. The transistor T6 has a first terminal coupled to the second terminal of the capacitor C1 and a control terminal receiving the gate driving signal G1 [n]. The transistor T7 has a first terminal coupled to a second terminal of the transistor T6, a second terminal coupled to the control terminal of the driving transistor TD, and a control terminal receiving the light-emitting signal GG-EM. The transistor T8 has a control terminal coupled to the second terminal of the capacitor C1 and a first terminal coupled to the second terminal of the transistor T6. The transistor T9 has a first terminal receiving the display data DATA[m], a second terminal coupled to a second terminal of the transistor T8, and a control terminal receiving the gate driving signal G1[n]. The transistor T10 has a first terminal receiving the reference voltage PPO, a second terminal coupled to the second terminal of the transistor T8, and a control terminal receiving the light-emitting signal GG-EM. The capacitor C2 has a first terminal receiving the power voltage VDD and the second terminal coupled to the control terminal of the driving transistor TD.

In the embodiment, the control switch 920 and the light-emitting time length modulator 930 are respectively composed of the transistors T2 and T1 and together form an 11T2C circuit structure. Similar to the pixel circuit provided in the embodiment depicted in FIG. 8, the pixel circuit 900 may be arranged in a display panel having a pixel circuit array and may drive the light-emitting device LED1 in a preset time sequence according to the gate driving signals G1[n] and G2[n] and the timing control signal TCS.

Figure 10:
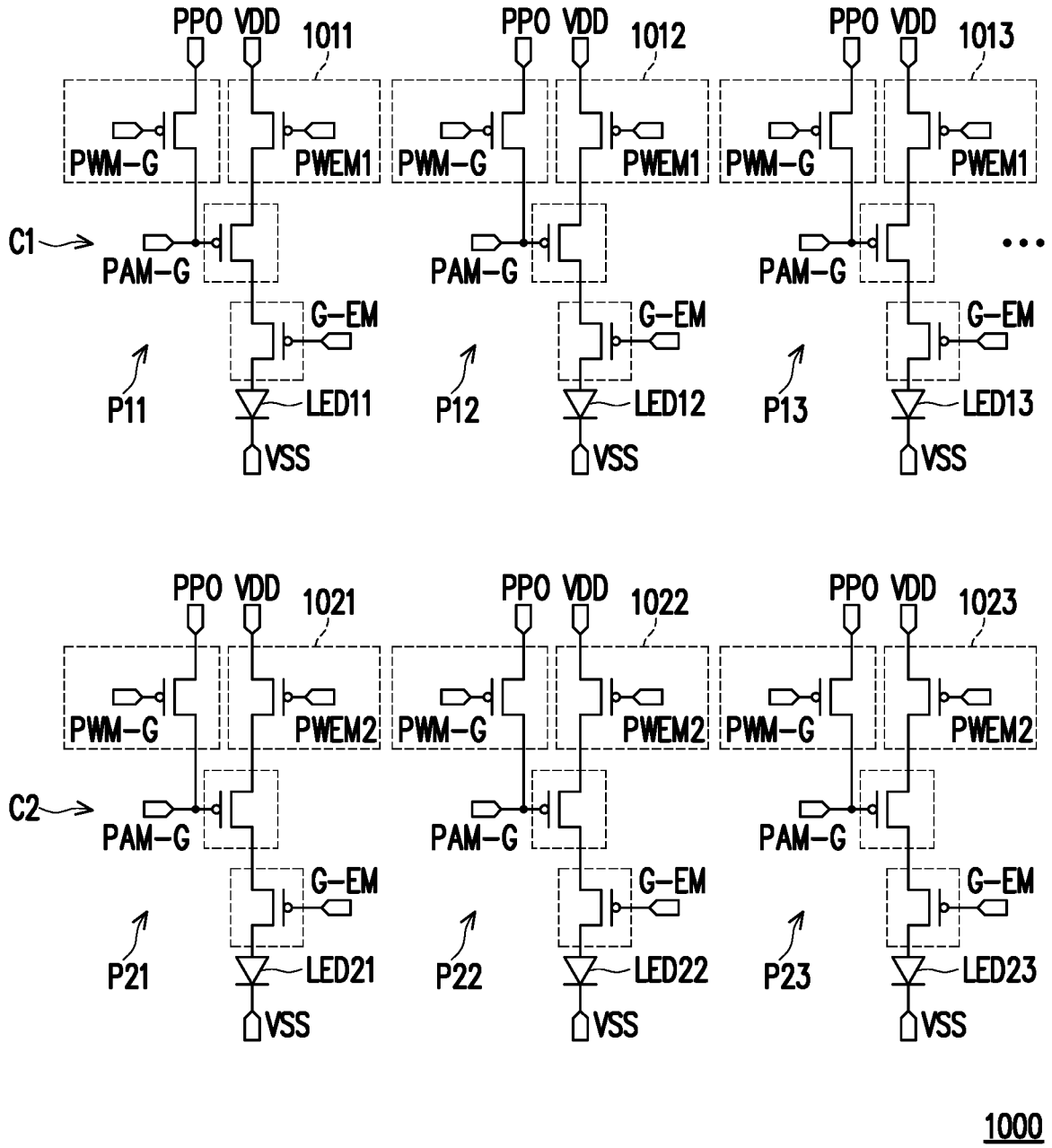
FIG. 10 is a schematic diagram of a display panel according to an embodiment of the disclosure.

FIG. 10 is a schematic diagram of a display panel according to an embodiment of the disclosure. As shown in FIG. 10, a display panel 1000 includes a plurality of pixel circuits P11-P23. Here, the pixel circuits P11-P13 form a first pixel array PC1, and the pixel circuits P21-P23 form a second pixel array PC2. The first pixel array PC1 and the second pixel array PC2 are staggered. In addition, the pixel circuits P11-P23 may be implemented in form of any of the pixel circuits provided in the foregoing embodiments, which should not be construed as a limitation in the disclosure. It is worth mentioning that in the pixel circuits P11-P13 of the first pixel array PC1, light-emitting time length modulators 1011-1013 respectively constituting the pixel circuits P11-P13 are commonly controlled by the light-emitting time control signal PWEM1. In the pixel circuits P21-P23 of the second pixel array PC2, light-emitting time length modulators 1021-1023 respectively constituting the pixel circuits P21-P23 are commonly controlled by another light-emitting time control signal PWEM2.

Figure 11:
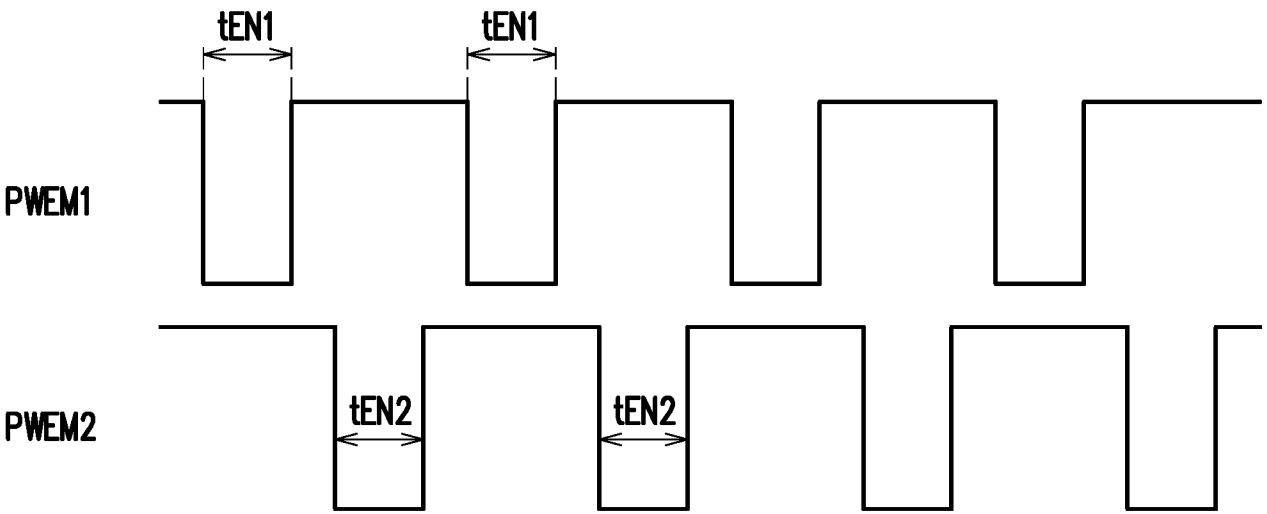
FIG. 11 is an operational waveform of the light-emitting time control signal according to the embodiment depicted in FIG. 10.

Please refer to FIG. 10 and FIG. 11 synchronously, wherein FIG. 11 is an operational waveform of the light-emitting time control signal according to the embodiment depicted in FIG. 10. In the embodiment, the light-emitting time control signal PWEM1 and the light-emitting time control signal PWEM2 may perform the transition operation in the same first time period. Note that the time periods tEN1 and tEN2 during which the light-emitting time control signal PWEM1 and the light-emitting time control signal PWEM2 are enabled (pulled down to a relatively low voltage level) are sequential and do not overlap. In other words, in the same display panel 1000, the time period during which the pixel circuits P11-P13 provide a driving current to the corresponding light-emitting devices LED11-LED13 and the time period during which the pixel circuits P21-P23 provides a driving current to the corresponding light-emitting devices LED21-LED23 do not overlap. Thereby, given that the display quality of the display panel 1000 stays unchanged, the total amount of current generated by the display panel 1000 at the same time point may be reduced, the burden on power supply may be effectively reduced, and potential electromagnetic interference may be mitigated.

Incidentally, the light-emitting devices of the display panel 1000 may be divided into three groups (or more) through three (or more) light-emitting time control signals that are sequentially enabled, and the light-emitting devices may be lit up in different time periods, which may more effectively reduce the total amount of current generated by the display panel 1000 at the same time point.

Figure 12A:
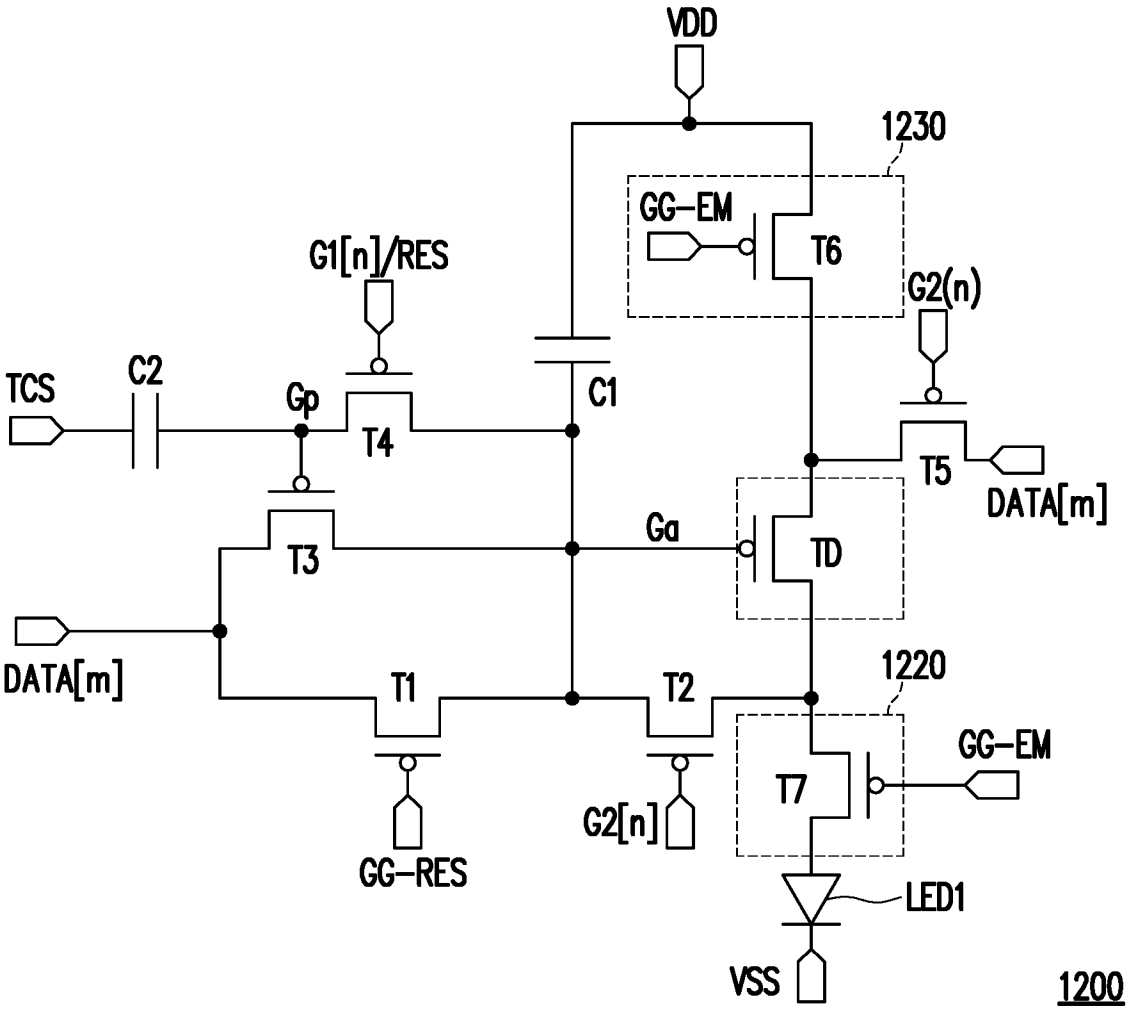
FIG. 12A is a schematic diagram of a pixel circuit according to another embodiment of the disclosure.

FIG. 12A is a schematic diagram of a pixel circuit according to another embodiment of the disclosure. As shown in FIG. 12A, a pixel circuit 1200 includes control switches 1220 and 1230, the driving transistor TD, the transistors T1-T5, and the capacitors C1-C2, and the transistors T1-T5 and the capacitors C1-C2 constitute peripheral circuits. The control switches 1220 and 1230 are composed of the transistors T7 and T6, respectively. The pixel circuit 1200 is configured to drive the light-emitting device LED1.

In the detailed circuit structure, the control switch 1230 has a first terminal receiving the power voltage VDD, and the control switch 1230 is controlled by the light-emitting signal GG-EM. The driving transistor TD has the first terminal coupled to the second terminal of the control switch 1230. The control switch 1220 is coupled between the second terminal of the driving transistor TD and the light-emitting device LED, and the control switch 1230 is controlled by light-emitting signal GG-EM. One terminal of the capacitor C1 receives the power voltage VDD, and the other terminal is coupled to the control terminal of the driving transistor TD. The transistor T1 has the first terminal receiving the display data DATA[m], the second terminal coupled to the control terminal of the driving transistor TD, and the control terminal receiving the reset signal GG-RES. The transistor T2 has the first terminal coupled to the second terminal of the transistor T1, the second terminal coupled to the second terminal of the driving transistor TD, and the control terminal receiving the gate driving signal G2[n]. The transistor T3 has the first terminal receiving the display data DATA[m] and the second terminal coupled to the control terminal of the driving transistor TD. One terminal of the capacitor C2 receives the timing control signal TCS, and the other terminal is coupled to the control terminal of the transistor T3. The transistor T4 has the first terminal coupled to the control terminal of the transistor T3, the second terminal coupled to the control terminal of the driving transistor TD, and the control terminal receiving the reset signal RES or the gate driving signal G1 [n]. The transistor T5 has the first terminal receiving the display data DATA [m], the second terminal coupled to the first terminal of the driving transistor TD, and the control terminal receiving the gate driving signal G2[n].

Figure 12B:
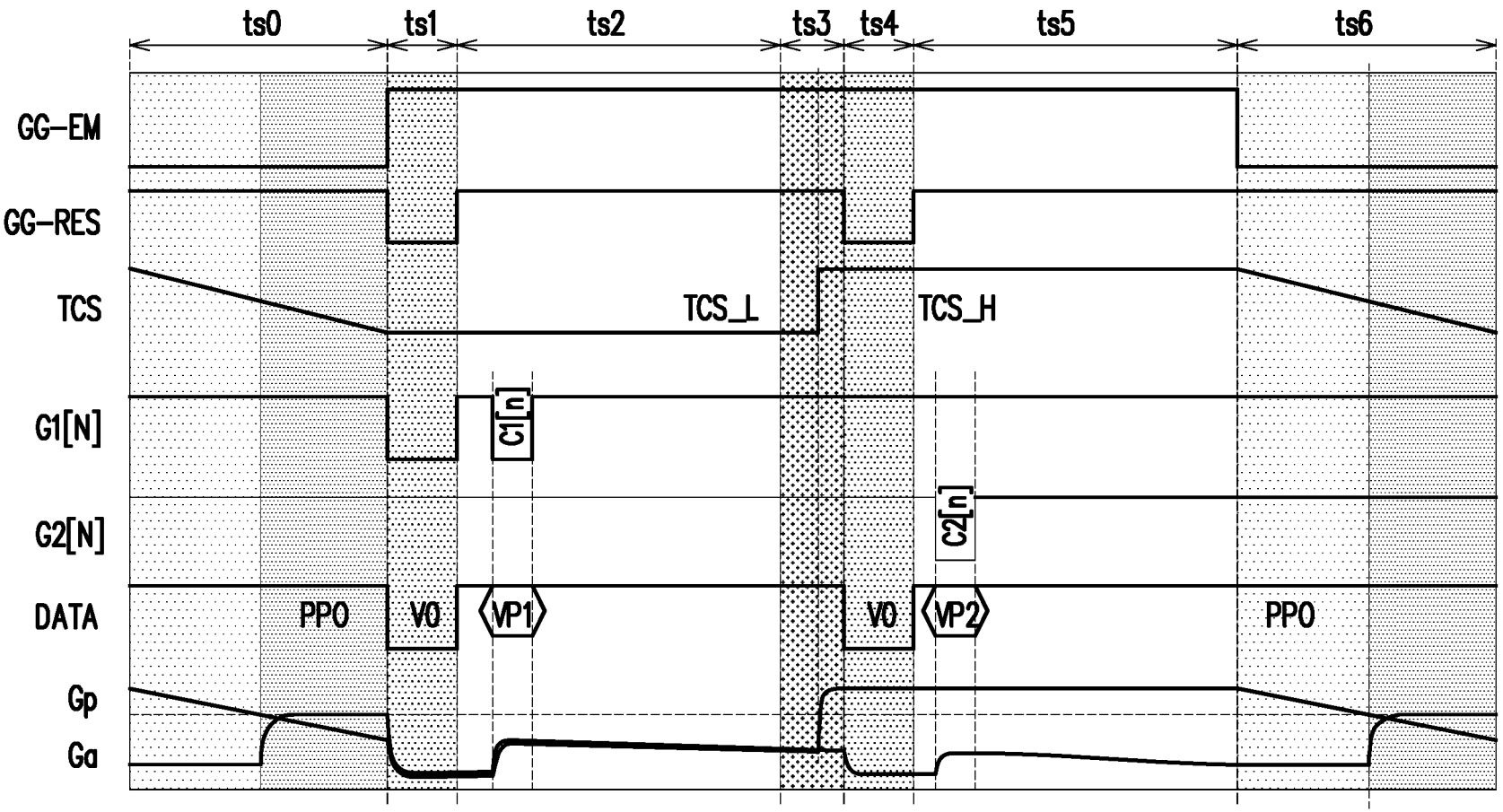
FIG. 12B is an operational waveform of a pixel circuit 1200 according to an embodiment of the disclosure.

In terms of operation, please refer to FIG. 12B, which is an operational waveform of a pixel circuit 1200 according to an embodiment of the disclosure. In a first driving stage ts0, the timing control signal TCS is a descending ramp wave, the transistors T3, T6, T7 and the driving transistor TD are switched on, and the remaining transistors T1, T2, T4, and T5 are all switched off. At this time, a signal Gp continues to descend along with the timing control signal TCS, and the voltage level of the display data DATA[m] is set to the PWM pinch off voltage (e.g., the reference voltage PPO), and when the voltage of the timing control signal TCS is sufficiently low, the voltage is transmitted to the control terminal of the driving transistor TD through the transistor T3 to raise a driving signal Ga. As such, the voltage difference between the gate and the source of the driving transistor TD may be greater than zero.

Next, in a second driving stage ts1, the transistors T1 and T4 are switched on by the reset signals RES and GG-RES, and the transistors T6 and T7 are switched off by the light-emitting signal GG-EM. As such, the second terminal of the capacitor C2 (the coupling end point to the transistor T4) may form a loop through the transistors T1 and T4. By setting the display data DATA[m] to be at the voltage level of the reference power VSS, for instance, the voltage of the signal Gp and the driving signal Ga may be pulled down. At this time, the timing control signal TCS may be a relatively low voltage TCS_L (for instance, equal to the reference power VSS).

In a third driving stage ts2, the transistor T1 is changed to an off state. The display data DATA[m] provide pulse width modulation data VP1 of the light-emitting device LED1 written into the capacitor C2 through the transistors T3 and T4 when the gate driving signal G1[n] is pulled down.

Next, in a fourth driving stage ts3, the transistor T4 is switched off. The timing control signal TCS is pulled up to a relatively high voltage level TCS_H at a time point, so that the capacitor C2 pumps up the voltage. Thereby, the voltage level of the signal Gp at the second terminal of the capacitor C2 may be substantially equal to VP1−Vth+TCS_H. Here, VP-Vth is the voltage level actually written to the capacitor C2, and Vth is the on-voltage of the transistor T4.

In a fifth driving stage ts4, the voltage level of the display data DATA[m] is again set to a voltage VO, for instance, and the transistor T1 is switched on to reset the driving signal Ga at the driving terminal of the driving transistor TD and the capacitor C1 through the switched-on transistor T1.

In a sixth driving stage ts5, the transistor T1 is changed to be switched off, and the transistors T2 and T5 are changed to be switched on. At this time, the display data DATA[m] received by the transistor T5 are the amplitude modulation data VP2 and written to the control terminal of the driving transistor TD and the capacitor C1 through the switched-on transistors T5 and T2 when the gate driving signal G2[n] is pulled down.

In a seventh driving stage ts6, the transistors T2 and T5 are changed to be switched off, and the transistors T6 and T7 are switched on again. Thereby, the control terminal of the driving transistor TD generates the driving signal according to the voltage on the capacitors C1 and C2, so as to drive the light-emitting device LED1 to emit light.

According to the embodiment, by setting the control switch 1220, the impact of the parasitic capacitance of the light-emitting device LED1 on the pixel circuit 1200 may be blocked; besides, the cathode of the light-emitting device LED1 receives the stable DC reference power VSS, so that the light-emitting device LED1 may receive a relatively high driving current of the driving signal. In addition, the display data DATA[m] load some commands related to the scan action, which may improve the voltage setting performance of the pixel circuit 1200. In general, the pixel circuit 1200 requires eight transistors and two capacitors, and the number of the required circuit devices may be reduced to raise the price competitiveness.

Incidentally, the transistors T1-T5 and the driving transistor TD in this embodiment may be p-type transistors.

Figure 13:
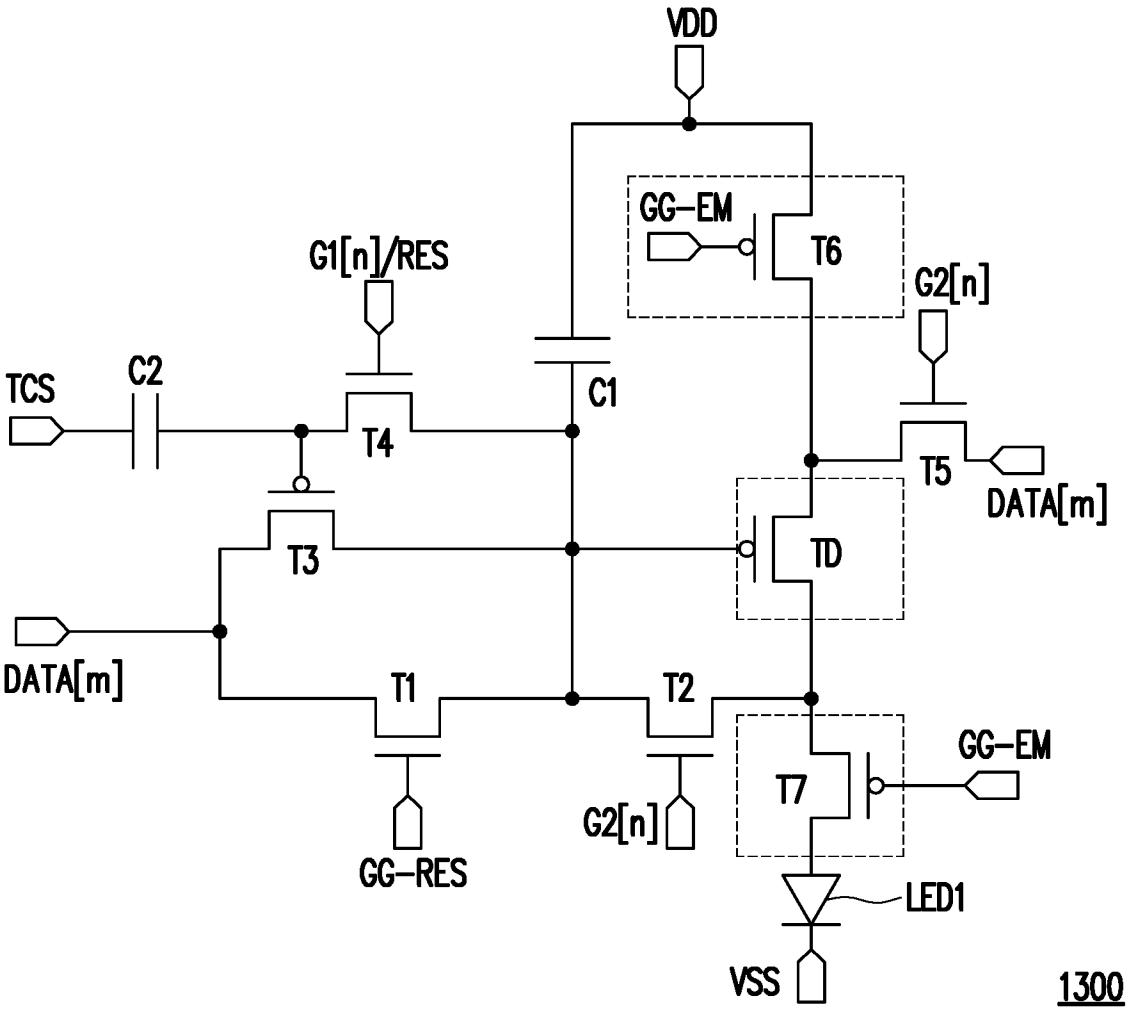
FIG. 13 is a schematic diagram of a pixel circuit according to another embodiment of the disclosure.

FIG. 13 is a schematic diagram of a pixel circuit according to another embodiment of the disclosure. As shown in FIG. 13, the circuit structure and the operation manner of the pixel circuit 1300 in FIG. 13 are similar to those of the pixel circuit 1200. The difference therebetween lies that the transistors T1-T5 in the embodiment depicted in FIG. 13 are n-type transistors. Here, the pixel circuit 1300 is designed to have the p-type transistors constituting the circuit that generates the driving signal (current) and have the n-type transistors T1, T2, T4, and T5 for locking the voltage at the control terminal of the driving transistor TD. In the embodiment, the structure of the complementary transistor may effectively reduce the required voltage level at the control terminal of the driving transistor TD, reduce possible current leakage of the driving transistor TD, optimize the capacitance value, and achieve high resolution.

To sum up, in the pixel circuit provided in one or more embodiments of the disclosure, the light-emitting time length modulator may be applied to adjust the brightness of the light emitted by the light-emitting device during the light-emitting time period. Thereby, low brightness display may be achieved while the EQE of the light-emitting device stays unchanged. In another embodiment of the disclosure, the pixel circuit with the simplified structure is provided, and the working performance of the pixel circuit may still remain high.

It will be apparent to those skilled in the art that various modifications and variations can be made to the disclosed embodiment without departing from the scope or spirit of the disclosure. In view of the foregoing, it is intended that the disclosure covers modifications and variations provided that they fall within the scope of the following claims and their equivalents.

What is claimed is:

1. A pixel circuit for driving a light-emitting device, the pixel circuit comprising:

a driving transistor, having a control terminal receiving a pulse width control signal and an amplitude control signal and generating a driving signal; and a light-emitting time length modulator, coupled to the driving transistor and the light-emitting device in series, the light-emitting time length modulator in a first time period modulating a time length of a plurality of second time periods during which the driving signal is provided to the light-emitting device according to a light-emitting time control signal.

2. The pixel circuit according to claim 1, further comprising:

a control switch, coupled to the driving transistor and the light-emitting device in series to control the first time period during which the driving transistor generates the driving signal according to a light-emitting signal.

3. The pixel circuit according to claim 2, wherein a frequency of the light-emitting time control signal is higher than a frequency of the light-emitting signal.

4. The pixel circuit according to claim 2, further comprising:

a pulse width control signal generator, coupled to the control terminal of the driving transistor and generating the pulse width control signal according to a pulse width modulation signal.

5. The pixel circuit according to claim 2, wherein the control switch is coupled between a first terminal of the driving transistor and the light-emitting device, and the light-emitting time length modulator is coupled between a second terminal of the driving transistor and a power voltage.

6. The pixel circuit according to claim 5, wherein the light-emitting time length modulator comprises a first transistor coupled between the second terminal of the driving transistor and the power voltage and controlled by a first light-emitting time control signal, and the control switch comprises a second transistor coupled between the first terminal of the driving transistor and a first light-emitting diode and controlled by a first light-emitting signal.

7. The pixel circuit according to claim 6, wherein the light-emitting time length modulator further comprises a third transistor coupled to the first transistor in parallel and controlled by a second light-emitting time control signal, and the control switch further comprises a fourth transistor coupled between the driving transistor and a second light-emitting diode and controlled by a second light-emitting signal.

8. The pixel circuit according to claim 7, wherein the light-emitting time length modulator further comprises a fifth transistor coupled to the first transistor and the third transistor in parallel and controlled by a third light-emitting time control signal, and the control switch further comprises a sixth transistor coupled between the driving transistor and a third light-emitting diode and controlled by a third light-emitting signal.

9. The pixel circuit according to claim 8, wherein wavelengths of light beams emitted by the first light-emitting diode, the second light-emitting diode, and the third light-emitting diode are different.

10. The pixel circuit according to claim 2, further comprising:

a third transistor, having a first terminal receiving display data, the third resistor being controlled by a first reset signal;

a fourth transistor, having a first terminal coupled to a second terminal of the third transistor and a second terminal coupled to a first terminal of the driving transistor, the fourth transistor being controlled by a first gate driving signal;

a first capacitor, coupled between a power voltage and the control terminal of the driving transistor;

a second capacitor, having a first terminal receiving a timing control signal;

a fifth transistor, having a first terminal coupled to a second terminal of the second capacitor, a control terminal receiving a second gate driving signal or a second reset signal, and a second terminal coupled to the control terminal of the driving transistor;

a sixth transistor, having a first terminal receiving the display data, a second terminal coupled to the control terminal of the driving transistor, and a control terminal coupled to the second terminal of the second capacitor; and a seventh transistor, having a first terminal receiving the display data, a second terminal coupled to a second terminal of the driving transistor, and a control terminal receiving the first gate driving signal.

11. The pixel circuit according to claim 2, further comprising:

a first capacitor, having a first terminal receiving a scan signal;

a third transistor, having a first terminal coupled to a second terminal of the first capacitor and a second terminal receiving a reference signal, the third transistor being controlled by a reset signal;

a fourth transistor, having a first terminal receiving the reference signal, a control terminal receiving the reset signal, and a second terminal coupled to the control terminal of the driving transistor;

a fifth transistor, having a first terminal coupled to the control terminal of the driving transistor, a second terminal coupled to a first terminal of the driving transistor, and a control terminal receiving a first gate driving signal;

a sixth transistor, having a first terminal coupled to the second terminal of the first capacitor and a control terminal receiving a second gate driving signal;

a seventh transistor, having a first terminal coupled to a second terminal of the sixth transistor, a second terminal coupled to the control terminal of the driving transistor, and a control terminal receiving the light-emitting signal;

an eighth transistor, having a control terminal coupled to the second terminal of the first capacitor and a first terminal coupled to the second terminal of the sixth transistor;

a ninth transistor, having a first terminal receiving display data, a second terminal coupled to a second terminal of the eighth transistor, and a control terminal receiving the second gate driving signal;

a tenth transistor, having a first terminal receiving a reference voltage, a second terminal coupled to the second terminal of the eighth transistor, and a control terminal receiving the light-emitting signal; and a second capacitor, having a first terminal receiving a power voltage and a second terminal coupled to the control terminal of the driving transistor.

12. A pixel circuit for driving a light-emitting device, the pixel circuit comprising:

a first control switch, having a first terminal receiving a power voltage, the first control switch being controlled by a light-emitting signal;

a driving transistor, having a first terminal coupled to a second terminal of the first control switch;

a second control switch, coupled between a second terminal of the driving transistor and the light-emitting device and controlled by the light-emitting signal;

a first capacitor, having one terminal receiving the power voltage and the other terminal coupled to a control terminal of the driving transistor;

a first transistor, having a first terminal receiving display data, a second terminal coupled to the control terminal of the driving transistor, and a control terminal receiving a first reset signal;

a second transistor, having a first terminal coupled to the second terminal of the first transistor, a second terminal coupled to the second terminal of the driving transistor, and a control terminal receiving a first gate driving signal;

a third transistor, having a first terminal receiving the display data and a second terminal coupled to the control terminal of the driving transistor;

a second capacitor, having one terminal receiving a timing control signal and the other terminal coupled to a control terminal of the third transistor;

a fourth transistor, having a first terminal coupled to the control terminal of the third transistor, a second terminal coupled to the control terminal of the driving transistor, and a control terminal receiving a second reset signal or a second gate driving signal; and a fifth transistor, having a first terminal receiving the display data, a second terminal coupled to the first terminal of the driving transistor, and a control terminal receiving the first gate driving signal.

13. The pixel circuit according to claim 12, wherein the light-emitting device is a light-emitting diode, an anode of the light-emitting diode is coupled to the second control switch, and a cathode of the light-emitting diode receives direct current reference power.

14. The pixel circuit according to claim 12, wherein both the first control switch and the second control switch are transistor switches.

15. The pixel circuit according to claim 14, wherein the driving transistor, the first transistor to the fifth transistor, the first control switch, and the second control switch are all p-type transistors.

16. The pixel circuit according to claim 14, wherein the driving transistor and the third transistor are p-type transistors, and the first transistor, the second transistor, the fourth transistor, the fifth transistor, the first control switch, and the second control switch are all n-type transistors.

17. A display panel, comprising:

a plurality of first pixel arrays, each of the first pixel arrays having a plurality of first pixel circuits; and a plurality of second pixel arrays, respectively staggered with the first pixel arrays, each of the second pixel arrays having a plurality of second pixel circuits, wherein each of the first pixel circuits and the second pixel circuits comprises:

a driving transistor, having a control terminal receiving a pulse width control signal and an amplitude control signal and generating a driving signal; and a light-emitting time length modulator, coupled to the driving transistor and the light-emitting device in series, the light-emitting time length modulator in a first time period modulating a time length of a plurality of second time periods during which the driving signal is provided to the light-emitting device according to a first light-emitting time control signal or a second light-emitting time control.

18. The display panel according to claim 17, wherein each of the first pixel circuits and the second pixel circuits further comprises:

a control switch, coupled to the driving transistor and the light-emitting device in series to control the first time period during which the driving transistor generates the driving signal according to a light-emitting signal.

19. The display panel according to claim 17, wherein a first enabling time period of the first light-emitting time control signal and a second enabling time period of the second light-emitting time control signal do not overlap.

20. The display panel according to claim 17, wherein a first enabling time period and a second enabling time period do not overlap.

21. The display panel according to claim 17, wherein a frequency of the light-emitting time control signal is higher than a frequency of the light-emitting signal.

22. The display panel according to claim 17, wherein the control switch is coupled between a first terminal of the driving transistor and the light-emitting device, and the light-emitting time length modulator is coupled between a second terminal of the driving transistor and a power voltage.

* * * * *